US005219072A

United States Patent [19]

Sauer

[11] Patent Number: 5,219,072

[45] Date of Patent: Jun. 15, 1993

[54] APPARATUS FOR CARRYING OR STORING BOTTLES

[76] Inventor: Henry J. Sauer, 2306 S. Anderson, Kennewick, Wash. 99337

[21] Appl. No.: 901,869

[22] Filed: Jun. 22, 1992

[51] Int. Cl.[5] ..... B65D 75/00; B65D 6/28; B65D 6/36; B65D 85/30

[52] U.S. Cl. ..... 206/139; 206/162; 206/428; 217/19; 217/21; 220/4.22; 220/4.24

[58] Field of Search ..... 217/19, 20, 21, 22; 206/427, 428, 139, 162; 220/4.22, 4.23, 4.24

[56] References Cited

U.S. PATENT DOCUMENTS

| | | | |
|---|---|---|---|
| 254,838 | 3/1882 | Peacock | 206/427 |
| 323,486 | 8/1885 | Aitcheson . | |
| 1,008,447 | 11/1911 | Distler . | |
| 1,965,886 | 7/1934 | Everhart . | |
| 1,995,280 | 3/1935 | Everhart . | |
| 2,487,491 | 11/1949 | Stone | 206/427 |
| 3,155,264 | 11/1964 | Shook | 220/4.22 X |

FOREIGN PATENT DOCUMENTS

| | | | |
|---|---|---|---|
| 82466 | 1/1964 | France | 217/19 |
| 16534 | of 1905 | United Kingdom | 217/19 |

*Primary Examiner*—William I. Price

*Attorney, Agent, or Firm*—Chernoff, Vilhauer, McClung & Stenzel

[57] ABSTRACT

An apparatus for safely carrying or storing necked bottles, in particular wine bottles, has a top, a bottom having an opening, and an intermediate structure with an aperture axially aligned with the opening in the bottom. The neck of an inverted bottle is inserted through and supported by the aperture in the intermediate structure. The top of the neck of the bottle fits into, and is supported by, the opening in the bottom. A hinged, openable enclosure surrounds the area between the top and intermediate structure.

7 Claims, 2 Drawing Sheets

APPARATUS FOR CARRYING OR STORING BOTTLES

BACKGROUND OF THE INVENTION

The present invention relates to an apparatus to enable necked bottles, especially wine bottles, to be safely carried or stored. In particular, the invention enables one or more necked bottles to be inverted and supported at two spaced locations on the bottle's neck.

Aitchenson et al. U.S. Pat. No. 323,486 discloses a box for bottled liquids with three different sets of partitioning rods arranged so that a bottle inserted neck first into the box is supported at the shoulder of the bottle by one set of rods and at two higher positions on the body of the bottle by the other sets of rods. Distler U.S. Pat. No. 1,008,447 discloses a hinged two-compartment bottle case in which the bottles in an upper compartment are held inverted, with their necks between necks of upright bottles in a lower compartment. The inverted bottles are supported at their shoulders by a single partition having openings for receiving the necks of the bottles. Everhart U.S. Pat. Nos. 1,965,886 and 1,995,280 disclose bottle carriers in which the bottles are carried upright by passing the necks of the bottles through apertures.

None of these prior bottle carriers is capable of supporting an inverted necked bottle at two locations on the neck so as to eliminate the need for any substantial support of the bottle's body portion.

SUMMARY OF THE INVENTION

The present invention comprises an apparatus for carrying or storing one or more inverted necked bottles, in particular wine bottles, in a simple structure which provides a high degree of safety from bottle breakage and easy insertability and removability of the bottle(s). Each bottle is held secure by placing the inverted neck of the bottle through a neck-receiving aperture in an intermediate structure that is parallel to and interposed in spaced relation between the top and bottom of the apparatus. A depression or other opening in the bottom of the apparatus which is axially aligned with the neck-receiving aperture of the intermediate structure engages the top of the neck, thereby cooperating with the aperture to substantially prevent lateral movement of the body of the inverted bottle. The prevention of lateral movement of the body of the bottle is particularly important where multiple bottle bodies are carried, so that the bodies do not strike against each other and shatter. The body of each bottle is surrounded by an openable elongate enclosure protecting the body from contact with obstacles or other hazards.

It is therefore a principal object of the present invention to provide a simple apparatus for carrying or storing inverted necked bottles whereby the bottles are secure from breakage, and nevertheless are easily inserted and removed.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
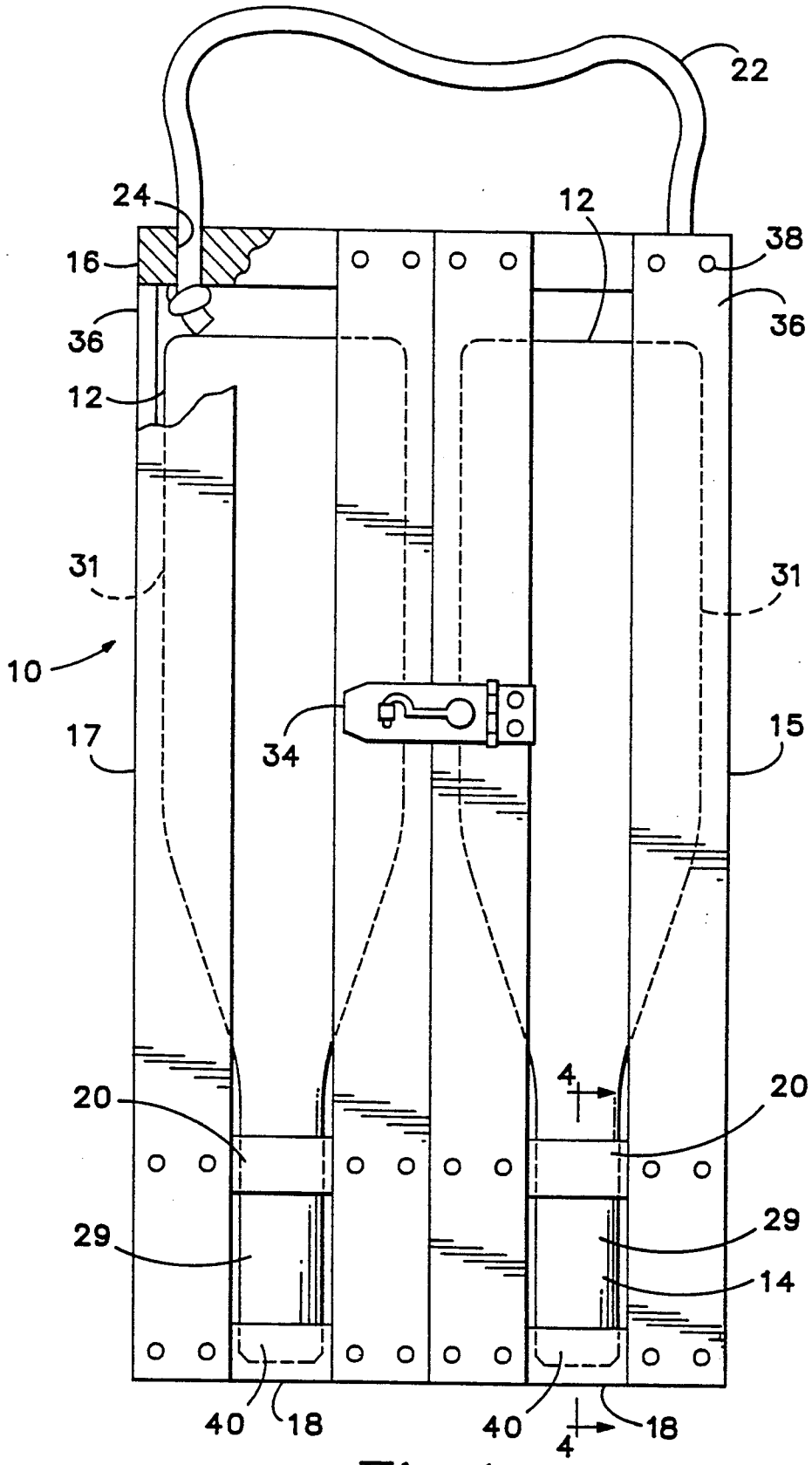
FIG. 1 illustrates a front view in partial cross section of an exemplary embodiment of an apparatus holding a pair of wine bottles, in accordance with the present invention.
Figure 2:
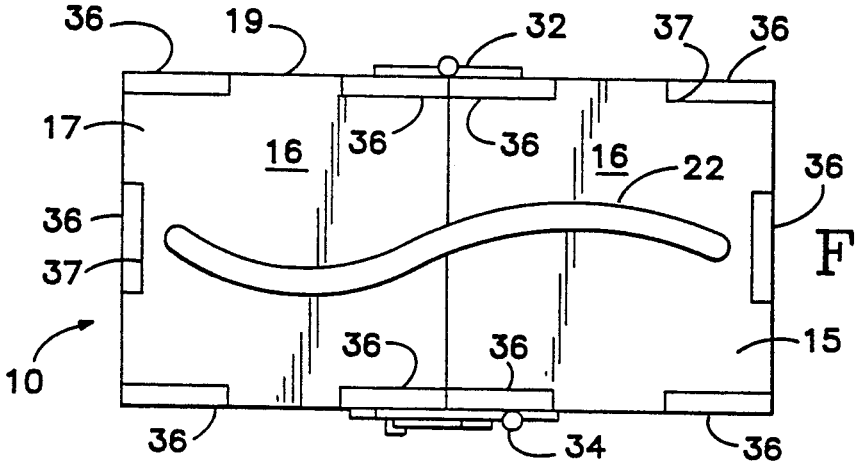
FIG. 2 illustrates a top plan view of the apparatus of FIG. 1.
Figure 3:
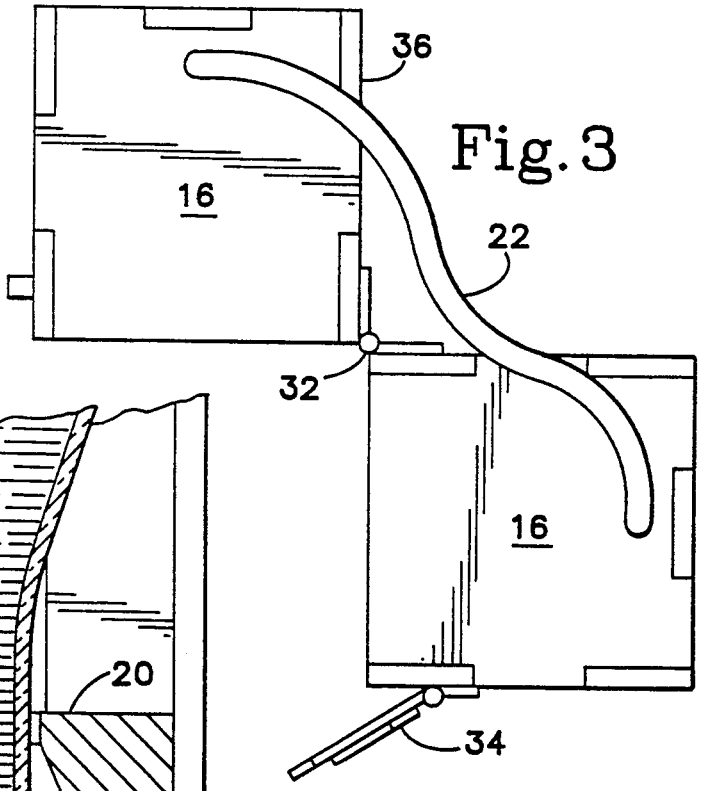
FIG. 3 illustrates a top plan view of the apparatus of FIG. 1 shown in the opened position.

With reference to a preferred embodiment shown in FIGS. 1–4, the apparatus 10 is shown configured to hold two wine bottles 12, one bottle in a right section 15, the other bottle in a left section 17. The wine bottles are separated from each other by a distance and are inserted vertically upside down with their tops 40 facing downward. With reference in particular to FIGS. 2 and 3, it can be seen that the right section 15 and the left section 17 are mirror images of each other.

FIGS. 1 and 2 show the apparatus 10 in its closed condition while FIG. 3 shows the apparatus 10 in its open condition with the sections 15 and 17 separated to enable insertion or removal of the bottles. The right section 15 and the left section 17 are attached on the back side by hinges such as 32 to enable such separation. A clasp 34 is used to secure the right section 15 and left section 17 in the closed position.

The right section 15 and left section 17 each has a top 16, a bottom 18, and an intermediate structure 20 which may be made from a suitable material such as wood, preferably oak. The top 16, bottom 18 and intermediate structure 20 are held apart from each other by transversely spaced elongate members 36, which may be oak slats, which are secured by mechanical fasteners 38 to notches 37 dadoed into the top 16, bottom 18, and intermediate structure 20.

A hole 24 is drilled through each top 16. The end of a length of rope is inserted through each hole 24 and a knot 25 is tied in each end of the rope, thus forming a handle 22 for carrying the apparatus 10. Rope or another similarly flexible material of sufficient length is most suitable for forming the handle because of the need for the sections 15 and 17 to separate hingedly from each other making a rigid handle unsuitable.

Figure 4:
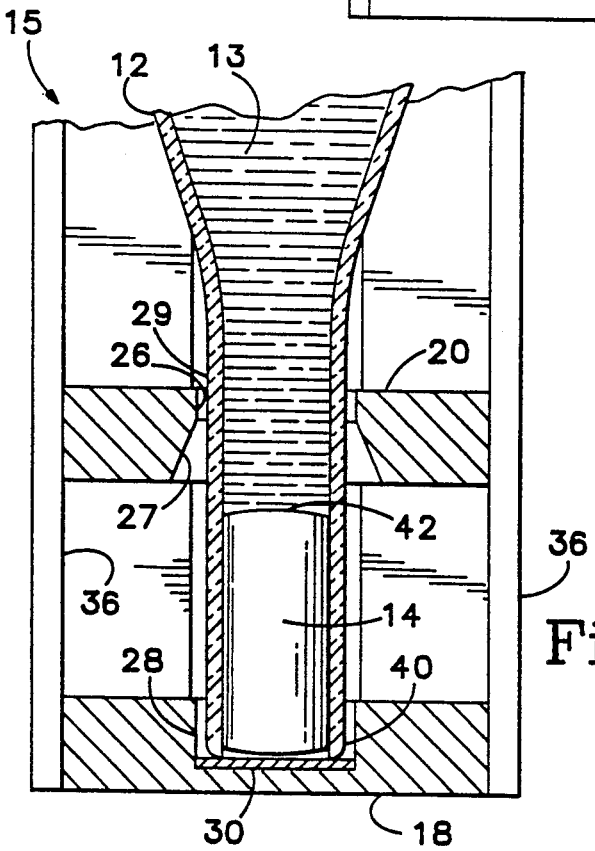
FIG. 4 illustrates a sectional detail view of the bottle neck-supporting structure of the apparatus, taken along line 4—4 of FIG. 1.

As can be seen with reference to FIGS. 1 and 4, when a wine bottle 12 is inserted into the apparatus 10, the neck 29 of the bottle passes loosely through a neck-supporting aperture 26 in the intermediate structure 20, the underside of the aperture 26 being beveled at 27 to facilitate insertion of the neck at an angle to the axis of the aperture 26 while the apparatus 10 is open. The top 40 of the wine bottle 12 is inserted into an upwardly-facing depression or other opening 28 on the upper facing surface of the bottom 18, such opening 28 being axially aligned with the aperture 26 in the intermediate structure 20. The top 40 of the neck may engage a pad 30 which may be composed of felt or a similar soft material that acts as a cushion for the top 40. Because the wine bottle 12 is inserted upside down, the wine 13 within the wine bottle 12 covers the inner end 42 of the cork 14. Because the cork is always exposed to a liquid, the cork 14 does not shrink and allow air to mix with the wine 13 and degrade the quality of the wine.

The spacing between the intermediate structure 20 and bottom 18 is such that the necks of most wine bottles, which may vary slightly in length or shape, will be engaged and supported against substantial lateral movement at two vertically spaced locations by the surrounding walls of the aperture 26 and the opening 28, respectively. This is sufficient to eliminate the need for any engagement of the bodies 31 of the wine bottles to support them during transport, since the neck engagements by the apertures 26 and openings 28 prevent them from striking each other.

The elongate upper part of each section 15, 17, which extends between the top 16 and intermediate structure 20, protects the bottle body from contact with obstacles or other hazards by forming an elongate enclosure around the body. In keeping with its body-protecting function, the length of such enclosure is substantially greater than the distance between the aperture 26 and opening 28, and its cross-section is likewise substantially greater than the cross-sectional areas of the aperture and opening.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An apparatus for holding one or more inverted bottles of the type having a neck and a body, said apparatus comprising:

(a) a top; (b) a bottom, said bottom having at least one opening facing said top; (c) an intermediate structure located between and spaced from said top and said bottom, said intermediate structure defining at least one aperture axially aligned with said opening in said bottom, said aperture and said opening being separated by an axial distance and having respective first and second cross-sectional areas for accepting the inserted neck of a bottle;

(d) means defining a selectively openable and closable elongate enclosure, extending between said top and said intermediate structure, said enclosure having an axial length between said top and said intermediate structure which is greater than said axial distance between said aperture and said opening, and having a cross-sectional area greater than either of said first and second cross-sectional areas for surrounding the body of said bottle.

2. The apparatus of claim 1 wherein said top includes a handle for carrying said apparatus.

3. The apparatus of claim 1, further comprising multiple ones of said apertures arranged in side-by-side relationship and multiple ones of said openings arranged in side-by-side relationship, each of said apertures being axially aligned with a respective one of said openings.

4. The apparatus of claim 1 wherein each of said bottom, said intermediate structure and said enclosure is composed of selectively separable respective parts to enable opening and closing of said apparatus for insertion and removal of a bottle.

5. The apparatus of claim 4 wherein said respective parts are hinged to each other to enable said opening and closing.

6. The apparatus of claim 5 wherein said hinge is oriented so as to pivot about an axis extending longitudinally with respect to said enclosure.

7. The apparatus of claim 1 wherein said enclosure comprises elongate members spaced transversely from each other extending longitudinally with respect to said enclosure.

* * * * *